US007497460B2

(12) United States Patent
Baumgartner et al.

(10) Patent No.: US 7,497,460 B2
(45) Date of Patent: Mar. 3, 2009

(54) SLIDING BOARD, PARTICULARLY A SKI

(75) Inventors: Manfred Baumgartner, Lichtenwoerth (AT); Alois Himmetsberger, Vienna (AT); Gernot Jahnel, Katzelsdorf (AT); Karl Stritzl, Vienna (AT); Hubert Wuerthner, Hainburg (AT)

(73) Assignee: Tyrolia Technology GmbH (AT)

( * ) Notice: Subject to any disclaimer, the term of this patent is extended or adjusted under 35 U.S.C. 154(b) by 0 days.

(21) Appl. No.: 10/548,150

(22) PCT Filed: Feb. 20, 2004

(86) PCT No.: PCT/EP2004/001656

§ 371 (c)(1),
(2), (4) Date: Sep. 2, 2005

(87) PCT Pub. No.: WO2004/078286

PCT Pub. Date: Sep. 16, 2004

(65) Prior Publication Data

US 2006/0163844 A1 Jul. 27, 2006

(30) Foreign Application Priority Data

Mar. 7, 2003 (AT) ..... A 349/2003

(51) Int. Cl.
*A63C 5/00* (2006.01)
*A63C 5/14* (2006.01)

(52) U.S. Cl. ..... 280/607; 280/609

(58) Field of Classification Search ..... 280/601, 280/607, 609, 610, 617
See application file for complete search history.

(56) References Cited

U.S. PATENT DOCUMENTS

| | | | | | |
|---|---|---|---|---|---|
| 5,143,395 | A * | 9/1992 | Mayr | ..... | 280/602 |
| 5,649,717 | A * | 7/1997 | Augustine et al. | ..... | 280/610 |
| 5,759,664 | A * | 6/1998 | Chisnell et al. | ..... | 428/109 |
| 5,836,604 | A | 11/1998 | Piegay | | |
| 5,871,223 | A * | 2/1999 | Zanco | ..... | 280/607 |
| 5,915,719 | A * | 6/1999 | Bauvois | ..... | 280/607 |
| 5,944,336 | A * | 8/1999 | Fagot | ..... | 280/607 |
| 6,758,487 | B1 * | 7/2004 | Stucki | ..... | 280/608 |
| 7,011,332 | B2 * | 3/2006 | Zanco | ..... | 280/602 |

FOREIGN PATENT DOCUMENTS

| | | | |
|---|---|---|---|
| DE | 43 28 840 | A1 * | 3/1995 |
| EP | 1 161 972 | A2 | 12/2001 |
| EP | 1 279 421 | A1 | 1/2003 |
| EP | 1 380 323 | A1 | 1/2004 |
| WO | 91/04770 | | 4/1991 |
| WO | 02/49728 | A1 | 6/2002 |

OTHER PUBLICATIONS

International Search Report issued Feb. 20, 2004.

* cited by examiner

*Primary Examiner*—Frank B Vanaman
(74) *Attorney, Agent, or Firm*—Ostrolenk, Faber, Gerb & Soffen, LLP

(57) ABSTRACT

A sliding board, particularly a ski, comprising a sliding surface, an upper shell, optionally, a core, steel edges, an upper belt and a lower belt, and comprising at least one interface element, which is joined to the sliding board body and which is provided for mounting at least one binding element on the top surface of the sliding board. The interface element(s) is/are shaped onto lateral flanks that extend along the longitudinal sides of the ski. These lateral flanks are bound in the sliding board construction during the production of the sliding board.

15 Claims, 2 Drawing Sheets

SLIDING BOARD, PARTICULARLY A SKI

CROSS REFERENCE TO RELATED APPLICATION

The present application is a 35 U.S.C. §371 national phase conversion of PCT/EP2004/001656 filed Feb. 20, 2004, which claims priority of Austrian application no. A 349/2003 filed Mar. 7, 2003, which are incorporated herein in their entirety.

BACKGROUND OF THE INVENTION

1. Field of the Invention

The invention relates to a sliding board, particularly a ski, with a running surface, an upper shell, optionally with a core, steel edges, an upper flange and a lower flange, and with at least one interface element connected to the sliding board body and intended for arranging at least one binding element on the upper side of the sliding board.

2. Background Art

EP-A-1 161 972 discloses a sliding board with a profiled rail system which comprises at least one rail extending in the longitudinal direction of the sliding board, which is connected to the sliding board body by a peg connection or anchorage by means of at least one formed-on peg or part of a peg. The fastening of the profiled rails is performed on the finished sliding board and consequently just replaces the otherwise customary screw fastening. In order to provide a sliding board with an already premounted profiled rail system, it is therefore necessary to carry out fastening and mounting operations on the finished sliding board.

SUMMARY OF THE INVENTION

The invention is based on the object of providing a sliding board which does not have this disadvantage.

The set object is achieved according to the invention by the interface element or elements being formed on side pieces which run along the longitudinal sides of the ski, the side pieces having been incorporated in the construction of the sliding board during the production of the sliding board.

According to the invention, side pieces provided with interface elements are therefore incorporated in the construction of the sliding board during its production. This dispenses with the subsequent fastening operations, such as screwing-on operations. The production of the sliding board continues to be very simple and, in particular, the activities of arranging bindings and ski binding parts, are rationalized considerably.

In the case of a preferred configuration of the invention, the side pieces have been connected to prepreg layers or the like during the pressing operation. In particular, the core may be built up from a number of layers separated from one another by at least one prepreg layer and optionally covered at least on one side likewise with at least one further prepreg layer. The prepreg layers in the core connect the individual core layers to one another and can at the same time be used in an advantageous way for also incorporating the side pieces in the body of the sliding board or connecting them to the core.

In this connection, it is advantageous if the side pieces have anchoring elements which are in contact with the prepreg layers.

It is also advantageous in this respect to insert the anchoring elements in the core during the production of the sliding board in such a way that they come into contact with their upper side and/or underside with prepreg layers and can in this way be incorporated in the construction of the sliding board.

BRIEF DESCRIPTION OF THE DRAWINGS

Further features, advantages and details of the invention are described in more detail on the basis of the drawings, which schematically represent an exemplary embodiment of the invention and in which.

DETAILED DESCRIPTION OF AN EMBODIMENT OF THE INVENTION

Figure 1:
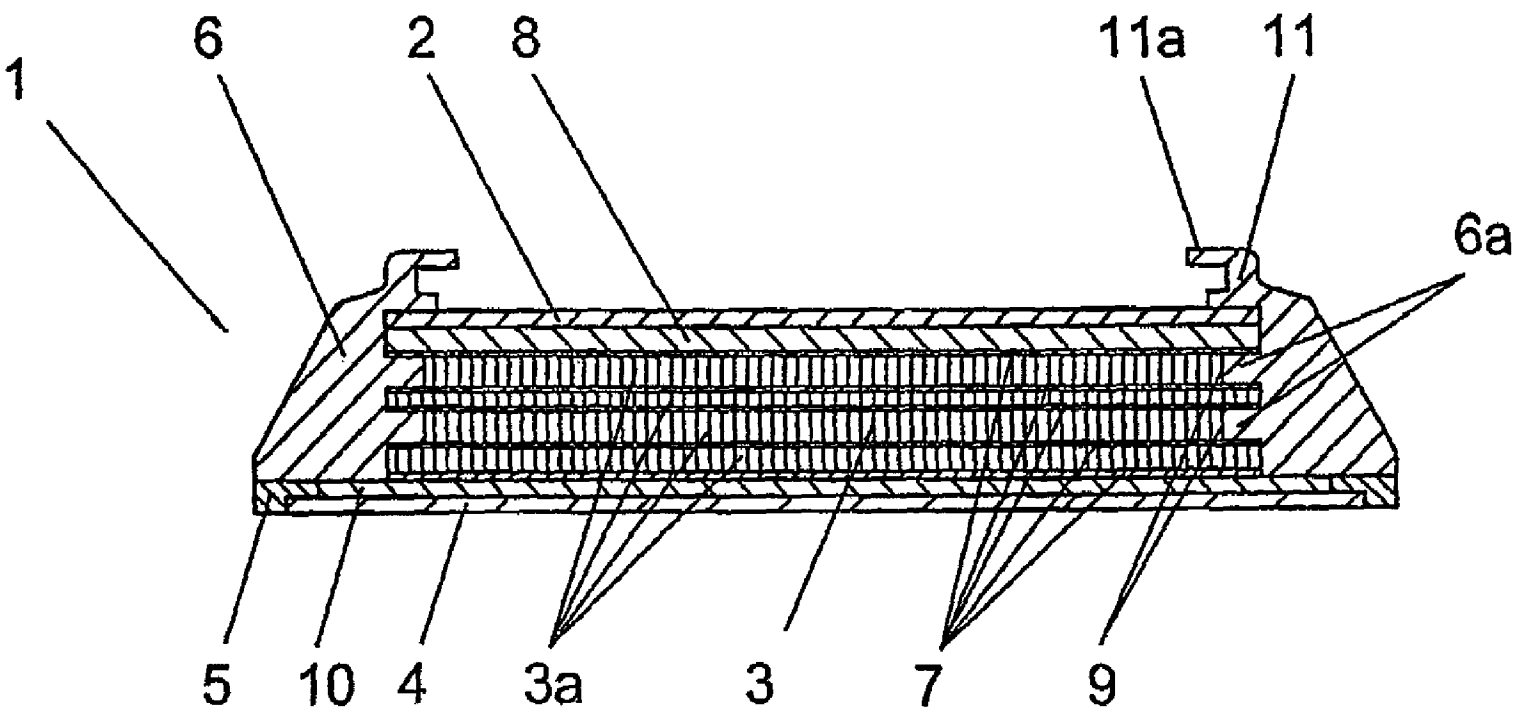
FIG. 1 shows a cross section through an embodiment of a ski configured according to the invention and FIG. 2 shows an oblique view of a ski configured according to the embodiment of FIG. 1.

FIG. 1 shows a cross section through a ski 1, which has an upper shell 2, a core 3, a running surface 4, steel edges 5 and a lower flange 10 running between the latter. A further layer, an upper flange 8, is introduced between the core 3 and the upper shell 2. The further construction of the ski 1 may comprise additional layers (not represented) or intermediate layers of different materials.

Figure 2:
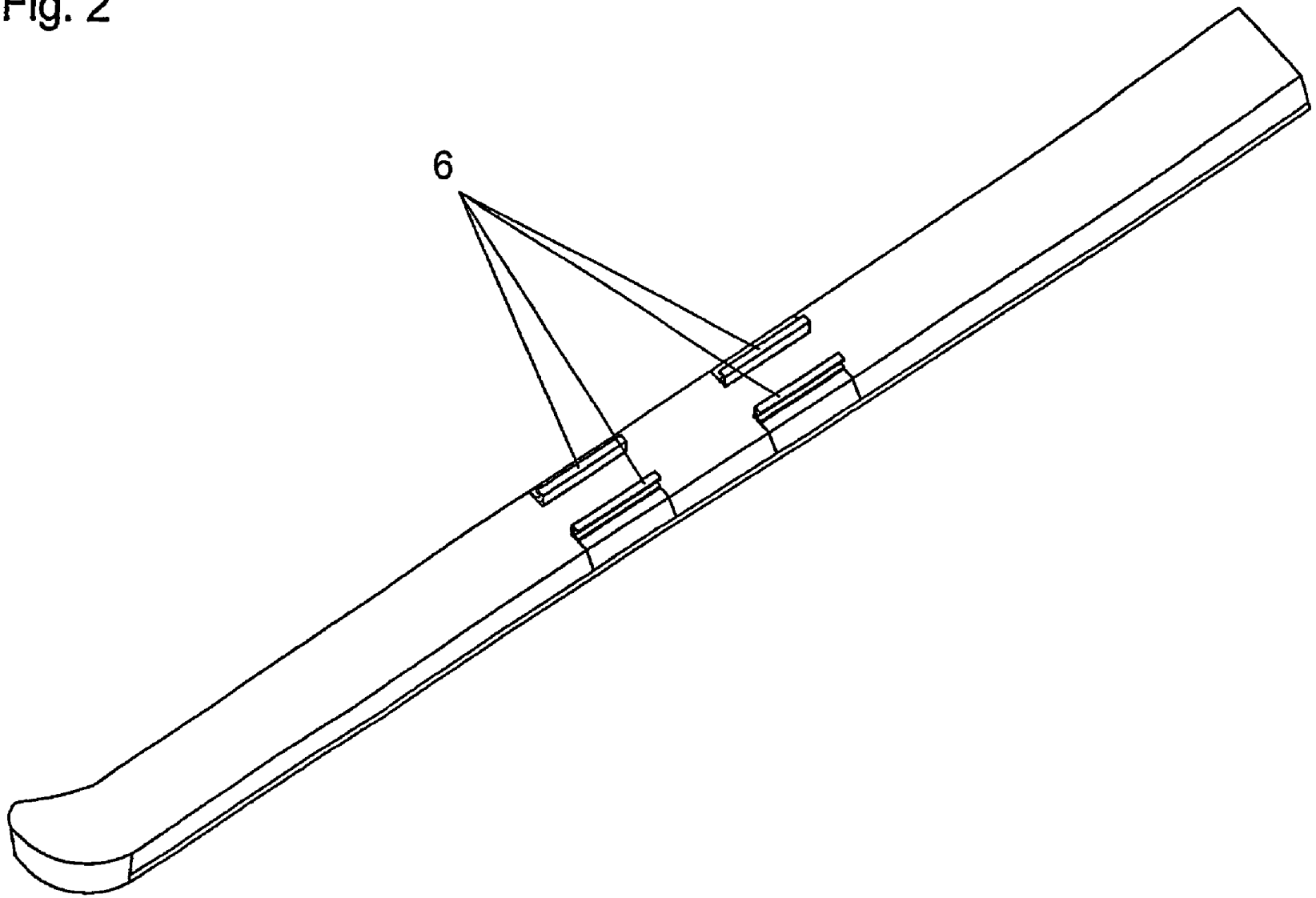

As FIG. 2 also shows, the side pieces 6 of the ski 1 are specially configured, at least in that region or in those regions where a ski binding or a ski binding part is to be arranged. The side pieces 6 are preferably injection-molded parts consisting of plastic, on which there are formed guiding elements 11 profiled with a rail-like shape, which are seated on the upper shell 2 of the ski 1 and have attachment parts 11*a*, which can be engaged over, for example by correspondingly bent edge regions of base plates or the like. In the case of the configuration shown, the attachment parts 11*a* face in the direction of the center of the ski.

Also formed on the side pieces 6 are anchoring elements 6*a*, facing in the direction of the center of the ski, by means of which the side pieces 6 are incorporated in the core 3. The core 3 is of a multilayered construction, at least in the region of the side pieces 6 provided with the guiding elements 11 profiled with a rail-like shape, and in the case of the configuration shown comprises four core layers 3*a*, in particular made of wood, which are separated from one another by prepreg layers 7. The uppermost core layer 3*a* is covered by a further prepreg layer 7; a prepreg layer 7 is preferably likewise introduced between the lower flange 10 and the core 3. Outside the regions where the guiding elements 11*a* profiled with a rail-like shape are provided, the core 3 may be constructed in a conventional manner. The prepreg layers 7 comprise in a known way a fabric, scrim or the like of fibers, preferably glass or aramid, embedded in a polymer material, for example epoxy resin or phenolic resin. The anchoring elements 6*a* of the side pieces 6 are inserted and accommodated in recessed regions 9 of two core layers 3*a* and are in contact with their upper side and underside here with one of the prepreg layers 7 in each case. In this way, the side pieces 6 are firmly incorporated in the initially liquefying and subsequently curing resin material of the prepreg layers 7 during the pressing operation of the ski 1, which is carried out in a mold while pressure and heat are supplied.

The two side pieces 6 may also have connecting parts, which pass through the ski in the transverse direction.

The invention has been described on the basis of a ski. It goes without saying that the invention may also be applied in the case of other sliding boards, for example snowboards.

Although the present invention has been described in relation to particular embodiments thereof, many other variations and modifications and other uses will become apparent to those skilled in the art. Therefore, the present invention is not limited by the specific disclosure herein.

The invention claimed is:

1. A sliding board comprising:

a running surface;

an upper shell;

a core;

at least two longitudinal sides; and two side pieces positioned at the longitudinal sides of the sliding board, a first side piece of the two side pieces being positioned at a first longitudinal side of the at least two longitudinal sides and a second side piece of the two side pieces being positioned at an opposed longitudinal side of the at least two longitudinal sides, the first side piece being separate and at a distance from the second side piece, each side piece further comprising an integrally formed rail-shaped guiding element extended from one of the longitudinal sides onto the upper shell of the sliding board, projected above the upper shell and configured to receive a binding element, wherein the rail-shaped guiding element includes an integrally-formed upright portion extending above the upper shell, a first integrally-formed member extending above the upper shell and transverse to the upright portion, and a second integrally-formed member extending above the first integrally-formed member and transverse to the upright portion.

2. The sliding board as claimed in claim 1, wherein the core comprises at least one prepreg layer sandwiched between at least two core layers, each side piece being connected to the at least one prepreg layer.

3. The sliding board as claimed in claim 2, wherein the at least one prepreg layer runs between two neighboring layers of the at least two core layers.

4. The sliding board as claimed in claim 2, wherein at least one additional prepreg layer is arranged on at least one of the upper shell and an underside of the core.

5. The sliding board as claimed in claim 2, wherein each side piece is connected to the at least one prepreg layer by at least one anchoring element facing toward a transverse center of the sliding board and is in direct connection with the at least one prepreg layer.

6. The sliding board as claimed in claim 5, wherein the at least one anchoring element is connected by its upper side and/or its underside to said prepreg layer.

7. The sliding board as claimed in claim 1, wherein the guiding elements have attachment portions mutually facing transversely across said sliding board for the pushing-in of the binding elements or base plates.

8. The sliding board as claimed in claim 1, wherein each of said two side pieces and said integrally formed rail-shaped guiding element are formed by injection molding.

9. A method for producing a sliding board having a running surface, an upper shell, a core, and two side pieces, a first side piece of the two side pieces being positioned at a first longitudinal side of the sliding board and a second side piece of the two side pieces positioned at a second longitudinal side of the sliding board, the second longitudinal side being opposite the first longitudinal side, the first side piece of the two side pieces being separate and at a distance from the second side piece, each side piece having an integrally formed rail-shaped guiding element extending from one of the longitudinal sides onto the upper shell of the sliding board, and configured to receive a binding element, wherein the rail-shaped guiding element includes an integrally-formed upright portion extending above the upper shell, a first integrally-formed member extending above the upper shell and transverse to the upright portion, and a second integrally-formed member extending above the first integrally-formed member and transverse to the upright portion, said method comprising:

pressing together the running surface, the two side pieces, the upper shell and the core to connect them to one another such that the rail-shaped guiding element of each side piece is positioned at one of the longitudinal sides, extending onto the upper shell and projecting above the upper shell.

10. The method of claim 9, further comprising:

placing at least one prepreg layer in the core, sandwiched between at least two other core layers; and connecting the two side pieces to the at least one prepreg layer by said pressing step.

11. The method of claim 10, wherein each of the two side pieces is connected to the at least one prepreg layer by at least one anchoring element facing toward a transverse center of the sliding board and is connected at least to a corresponding prepreg layer.

12. The method of claim 11, wherein the at least one anchoring element is connected by its upper side and/or its underside to said at least one prepreg layer.

13. The method of claim 9, wherein each of said two side pieces is integrally formed with said rail-shaped guiding element by injection molding.

14. A sliding board, comprising:

a running surface;

an upper shell;

a core comprising at least two core layers;

at least two longitudinal sides; and two side pieces positioned at the longitudinal sides of the sliding board, and at least one interface element arranged on the upper shell of the sliding board and adapted for receiving a binding element, the at least one interface element being integrally formed on at least one of the side pieces and thereby running along a longitudinal side of the sliding board with said at least one of the side pieces;

wherein the core comprises at least one prepreg layer sandwiched between the at least two core layers, wherein each side piece is connected to the at least one prepreg layer by at least one anchoring element facing toward a transverse center of the sliding board, and wherein the at least one anchoring element extends into a recessed region formed in the core, and is there connected to the at least one prepreg layer and to a second prepreg layer which sandwich said anchoring element on opposite sides of said recessed region.

15. A method for producing a sliding board having a running surface, an upper shell, a core comprising at least two core layers, at least two longitudinal sides and two side pieces positioned at the longitudinal sides of the sliding board, and at least one interface element arranged on the upper shell of the sliding board, the at least one interface element comprising a rail-shaped guiding element configured for receiving a binding element, the at least one interface element being integrally formed on at least one of the two side pieces and thereby running along one of the at least two longitudinal sides of the sliding board with said at least one side piece, said method comprising:

pressing together the running surface, the two side pieces, the upper shell and the core to connect them to one another such that the rail-shaped guiding element of each side piece is positioned at one of the longitudinal sides and extends onto the upper shell;

placing at least one prepreg layer in the core by sandwiching the at least one prepreg layer between the at least two core layers; and connecting the side pieces to the at least one prepreg layer by said pressing step, wherein each side piece of the two side pieces is connected to the at least one prepreg layer by at least one anchoring element facing toward a transverse center of the sliding board, wherein the at least one anchoring element is connected by its upper side and/or its underside to said at least one prepreg layer, and wherein the at least one anchoring element extends into a recessed region formed in the core, and is there connected to the at least one prepreg layer and to a second prepreg layer, the at least one prepreg layer and the second prepreg layer sandwiching said anchoring element on opposite sides of said recessed region.

* * * * *